US011317665B1

(12) United States Patent
Yu et al.

(10) Patent No.: US 11,317,665 B1
(45) Date of Patent: May 3, 2022

(54) EXTENSION STRAP FOR BRA

(71) Applicant: Chaobin Yu, Fujian (CN)

(72) Inventors: Chaobin Yu, Fujian (CN); Xingtong Yu, Fujian (CN); Zhenyuan Yu, Fujian (CN)

( * ) Notice: Subject to any disclaimer, the term of this patent is extended or adjusted under 35 U.S.C. 154(b) by 0 days.

(21) Appl. No.: 17/406,050

(22) Filed: Aug. 18, 2021

(30) Foreign Application Priority Data

Aug. 12, 2021 (CN) ..... 202110926606.8

(51) Int. Cl.
*A41F 1/00* (2006.01)
*A41C 3/00* (2006.01)

(52) U.S. Cl.
CPC ..... *A41F 1/006* (2013.01); *A41C 3/0028* (2013.01)

(58) Field of Classification Search
CPC ..... A41C 3/0028; A41F 1/006
USPC ..... 450/28, 82
See application file for complete search history.

(56) References Cited

U.S. PATENT DOCUMENTS 6,123,601 A * 9/2000 Hildebrandt ..... A41F 1/006 24/306
7,128,635 B1 * 10/2006 Liu ..... A41C 3/0014 450/39
2002/0068506 A1 * 6/2002 Devita ..... A41F 1/006 450/1
2004/0221434 A1 * 11/2004 Kaye ..... A41C 3/12 24/714.2
2007/0123148 A1 * 5/2007 Heer ..... A41D 15/00 450/77
2008/0045122 A1 * 2/2008 Utaka ..... A44B 13/00 450/25
2009/0223029 A1 * 9/2009 Leung ..... A44B 13/0052 24/698.1
2016/0150833 A1 * 6/2016 Spicer ..... A41C 3/06 450/70
2018/0303171 A1 * 10/2018 Lee ..... A41C 3/0028
2019/0357636 A1 * 11/2019 Utaka ..... F16B 1/00

* cited by examiner

*Primary Examiner* — Gloria M Hale

(57) ABSTRACT

An extension strap for a bra includes a base element, a first clasp element, a second clasp element and a fasten element group. The base element includes a first portion, a second portion and a third portion. The first portion includes a first accommodating space and a first opening. The first clasp element includes a first clasp and a first connection portion, the first connection portion is located in the first accommodating space, and the first clasp protruding from the first opening. The fasten element group includes at least two fasten elements disposed on the second portion, each fasten element includes a ring portion and a base portion connected between the ring portion and the second portion. The first clasp is configured to move along the first opening so as to change a distance between the first clasp element and the second clasp element.

20 Claims, 8 Drawing Sheets

EXTENSION STRAP FOR BRA

CROSS-REFERENCE TO RELATED APPLICATIONS

This application claims priority to Chinese Patent Application No. 202110926606.8 filed on Aug. 12,2021, the contents of which are incorporated by reference herein.

FIELD

The present disclosure relates to the field of women's underwear, and specifically to an extension strap for a bra.

BACKGROUND

Traditional bras include two cup portions for cover breasts, two back straps connected between the two cup portions, and two should straps connected between the two cup portions and the two back straps. The back straps and should straps are configured to put the bras on the users. Since the length of two back straps are fixed, when the users got fat, it may be difficult to put the bras on the users or it is uncomfortable when the users wear the bras.

An extension strap which can be connected between two back straps is provided to extend the length of the bras, such that the users may be easy to put on the bras or feel comfortable when the users wear the bras. However, the existing extension strap can not adapt to different bras with different clasp distances, the user experience of the existing extension strap may be low.

SUMMARY

In order to overcome the disadvantage of the existing extension strap, the present disclosure provides an extension strap for a bra including: a base element including a first portion, a second portion and a third portion, the first portion, the second portion and the third portion disposed in a first direction, the third portion connected between the first portion and the second portion, the first portion including at least one first holding space and at least one first opening communicating with the at least one first holding space, the second portion including at least one holding unit, each holding unit including at least one second holding space and at least one second opening communicating the at least one second holding space; a first hook element disposed on the first portion for connecting with a first back strap of the bra, the first hook element including a first hook and a first connection portion connected with the first hook, the first connection portion located in the first holding space, the first hook protruding from the first opening; a second hook element disposed on the first portion for connecting with the first back strap of the bra; at least one ring element group disposed on the second portion, each ring element group including a first ring element and a second ring element, both of the first ring element and the second ring element configured for connecting with a second back strap of the bra, the first ring element including a first ring portion and a first base portion connected with the first ring portion, the first base portion located in the second holding space, the first ring protruding from the second opening, the first hook configured to move along the first opening so as to change a distance between the first hook and the second hook, and the first ring portion configured to move along the second opening so as to change a distance between the first ring portion and the second ring portion.

Further, a number of the at least one first holding space is two, a number of the at least one first opening is two, each first opening communicates with a corresponding first holding space, the second hook element includes a second hook and a second connection portion connected with the second hook, the first connection portion and the second connection portion are located in the first holding spaces respectively, the second hook protrudes from a corresponding first opening, the second hook is configured to move in the corresponding first opening so as to change the distance between the first hook and the second hook along a second direction perpendicular to the first direction.

Further, a number of the at least one first holding space is three, a number of the at least one first opening is three, each first opening communicates with a corresponding first holding space, the extension strap further includes a third hook element disposed on the first portion, the second hook element includes a second hook and a second connection portion connected with the second hook, the third hook element includes a third hook and a third connection portion connected with the third hook, the first connection portion, the second connection portion and the third connection portion are located in the three first holding spaces respectively, the second hook protrudes from a corresponding first opening, the second hook is configured to move in the corresponding first opening so as to change the distance between the first hook and the second hook and a distance between the second hook and the third hook, the third hook protrudes from a corresponding first opening, the third hook is configured to move in the corresponding first opening so as to change the distance between the second hook and the third hook along a second direction perpendicular to the first direction, and the first hook element, the second hook element and third hook element are disposed in the second direction.

Further, a number of the at least one second holding space is two, a number of the at least one second opening is two, each second opening communicates with a corresponding second holding space, the second ring element includes a second ring portion and a second base portion connected with the second ring portion, the first base portion and the second base portion are located in the second holding spaces respectively, the second ring portion protrudes from a corresponding second opening, the second ring portion is configured to move along the corresponding second opening so as to change the distance between the first ring element and the second ring element along a second direction perpendicular to the first direction.

Further, a number of the at least one second holding space is three, a number of the at least one second opening is three, each second opening communicates with a corresponding second holding space, each ring element group further includes a third ring element, the second ring element includes a second ring portion and a second base portion connected with the second ring portion, the third ring element includes a third ring portion and a third base portion connected with the third ring portion, the first base portion, the second base portion and the third portion are located in the three second holding spaces respectively, the second ring portion protrudes from a corresponding second opening, the second ring portion is configured to move along the corresponding second opening so as to change the distance between the first ring element and the second ring element along a second direction perpendicular to the first direction and a distance between the second ring element and the third ring element along the second direction, the third ring portion protrudes from a corresponding second opening, the third ring portion is configured to move along the corresponding second opening so as to change the distance between the second ring portion and the third ring portion along the second direction.

Further, when the first hook moves along the first opening, the first connection portion moves along the first holding space, and when the first ring portion moves along the second opening, the second connection portion moves along the second holding space.

Further, the first hook element and the second hook element are disposed in a second direction perpendicular to the first direction; the first ring element and the second ring element are disposed in a third direction parallel to the second direction.

Further, the first hook element and the second hook element are disposed at an end of the first portion, both of the first hook and the second hook extend towards a first side of the base element, and the ring element group is disposed at a second side opposite to the first side of the base element.

Further, a number of the at least one ring group is three, a number of the at least one holding unit are three, and the three ring groups are disposed in the first direction and correspond to the three holding units respectively.

Further, the third portion is made of elastic material, a width of the third portion along a direction perpendicular to the first direction is less than a width of the first portion along the direction perpendicular to the first direction, the width of the third portion along the direction perpendicular to the first direction is less than a width of the second portion along the direction perpendicular to the first direction.

Further, the first portion includes a first edge portion, a second edge portion connected an end of the first edge portion and a third edge portion connected the other end of the first edge portion, a first chamfer is formed between the first edge portion and the second edge portion, a second chamfer is formed between the first edge portion and the third edge portion, the second portion includes a fourth edge portion, a fifth edge portion connected an end of the fourth edge portion and a sixth edge portion connected the other end of the fourth edge portion, a third chamfer is located between the fourth edge portion and the fifth edge portion, and a fourth chamfer is located between the fourth edge portion and the sixth edge portion.

In order to overcome the disadvantage of the existing extension strap, the present disclosure also provides an extension strap for a bra including: a base element including a first portion, a second portion and a third portion, the first portion, the second portion and the third portion disposed in a first direction, the third portion connected between the first portion and the second portion, the first portion including at least one first holding space and at least one first opening communicating with the at least one first holding space; a first hook element disposed on the first portion for connecting with a first back strap of the bra, the first hook element including a first hook and a first connection portion connected with the first hook, the first connection portion located in the first holding space, the first hook protruding from the first opening; a second hook element disposed on the first portion for connecting with the first back strap of the bra, the first hook element and the second hook element disposed in a second direction perpendicular to the first direction; at least one ring element group disposed on the second portion for connecting with a second back strap, the first hook configured to move along the first opening in the second direction so as to change a distance between the first hook element and the second hook element in the second direction.

Further, a number of the at least one first holding space is at least two, a number of the at least one first opening is at least two, each first opening communicates with a corresponding first holding space, the second hook element includes a second hook and a second connection portion connected with the second hook, the first connection portion and the second connection portion are located in the two first holding spaces respectively, the second hook protrudes from a corresponding first opening, the second hook is configured to move along the first opening in the second direction so as to change the distance between the first hook element and the second hook element along the second direction.

Further, a number of the at least one first holding space is at least three, a number of the at least one first opening is at least three, each first opening communicates with a corresponding first holding space, the extension strap further includes a third hook element disposed on the first portion, the second hook element includes a second hook and a second connection portion connected with the second hook, the third hook element includes a third hook and a third connection portion connected with the third hook, the first connection portion, the second connection portion and the third connection portion are located in the three first holding spaces respectively, the second hook protrudes from a corresponding first opening, the second hook is configured to move in the corresponding first opening along the second direction so as to change the distance between the first hook element and the second hook element and a distance between the second hook element and the third hook element, the third hook protrudes from a corresponding first opening, the third hook is configured to move in the corresponding first opening along the second direction so as to change the distance between the second hook element and the third hook element, and the first hook element, the second hook element and third hook element are disposed in the second direction.

Further, a number of the at least one ring element group is at least two, the at least two ring element groups are arranged in the first direction, the second portion includes at least two holding units corresponding to the at least two ring element groups, each holding unit including at least two second holding space corresponding to the at least two ring elements and at least two second openings communicating with the at least two second holding spaces respectively, each ring element includes a base portion and a ring portion connected with the base portion, the base portion is located in a corresponding second holding space, the ring portion protrudes from the second opening, the ring portion is configured to move in the corresponding second opening along the third direction parallel to the second direction so as to change the distance between two ring elements.

Further, the first hook element and the second hook element are disposed at an end, both of the first hook and the second hook extend towards a first side of the base element, the ring element group is disposed at a second side opposite to the first side of the base element.

Further, the third portion is made of elastic material, a width of the third portion along a direction perpendicular to the first direction is less than a width of the first portion along the direction perpendicular to the first direction, the width of the third portion along the direction perpendicular to the first direction is less than a width of the second portion along the direction perpendicular to the first direction.

Further, the first portion includes a first edge portion, a second edge portion connected an end of the first edge portion and a third edge portion connected the other end of the first edge portion, a first chamfer is located between the first edge portion and the second edge portion, a second chamfer is located between the first edge portion and the third edge portion; the second portion includes a fourth edge portion, a fifth edge portion connected an end of the fourth edge portion and a sixth edge portion connected the other end of the fourth edge portion, a third chamfer is located between the fourth edge portion and the fifth edge portion, a fourth chamfer is located between the fourth edge portion and the sixth edge portion.

Further, the least one ring element group includes at least two ring elements, each ring element includes a ring portion and a base portion connected between the ring portion and the second portion, and an inner diameter of the ring portion along the second direction is greater than a width of the first hook along the second direction.

Further, the inner diameter of the ring portion along the second direction is greater than two times of the width of the first hook along the second direction.

It can be understood, because the distance between the two hook elements can be changed, the extension strap can be used in different bras with different hook distances, the user experience of the extension strap can be improved.

BRIEF DESCRIPTION OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application. For ordinary skill in the art, they may obtain other drawings according to these attached drawings without any innovative laboring.

The present disclosure will be further described with reference to the attached drawings and the embodiments hereunder.

DETAILED DESCRIPTION

Figure 1:
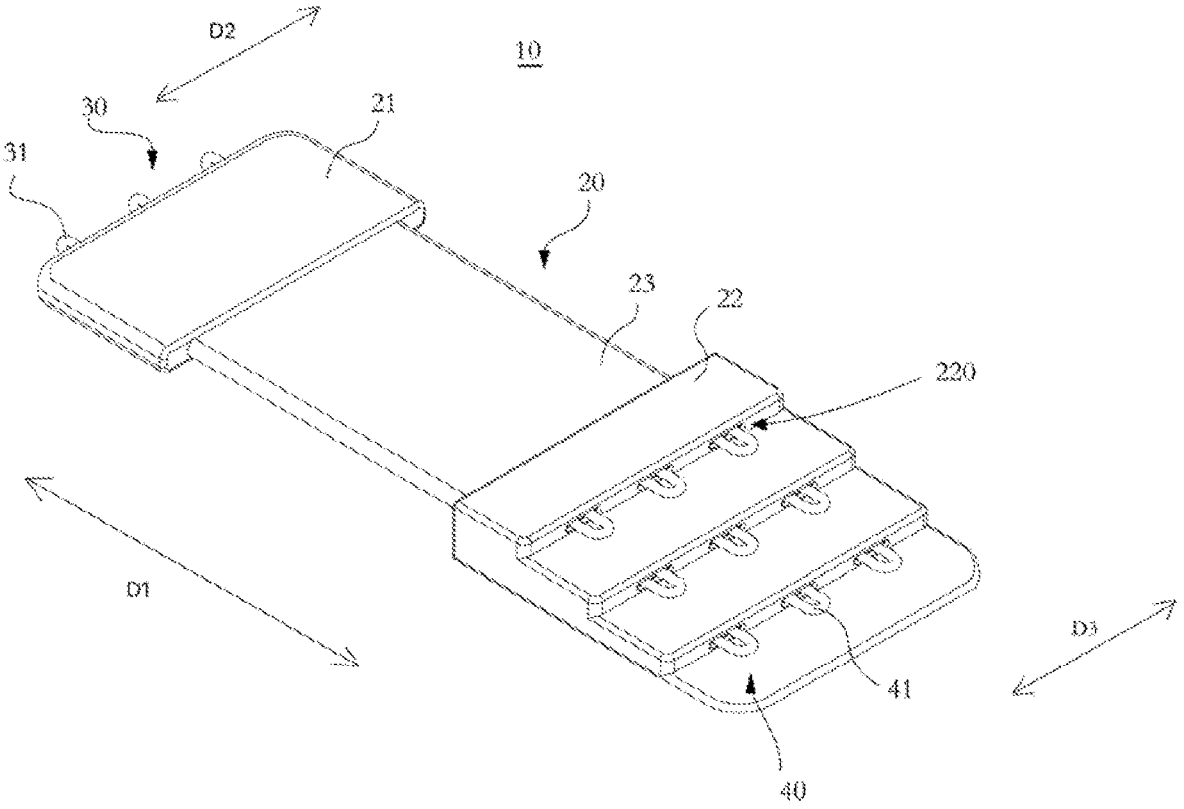
FIG. 1 is a schematic view of an extension strap for a bra according to a first embodiment of the present disclosure.
Figure 2:
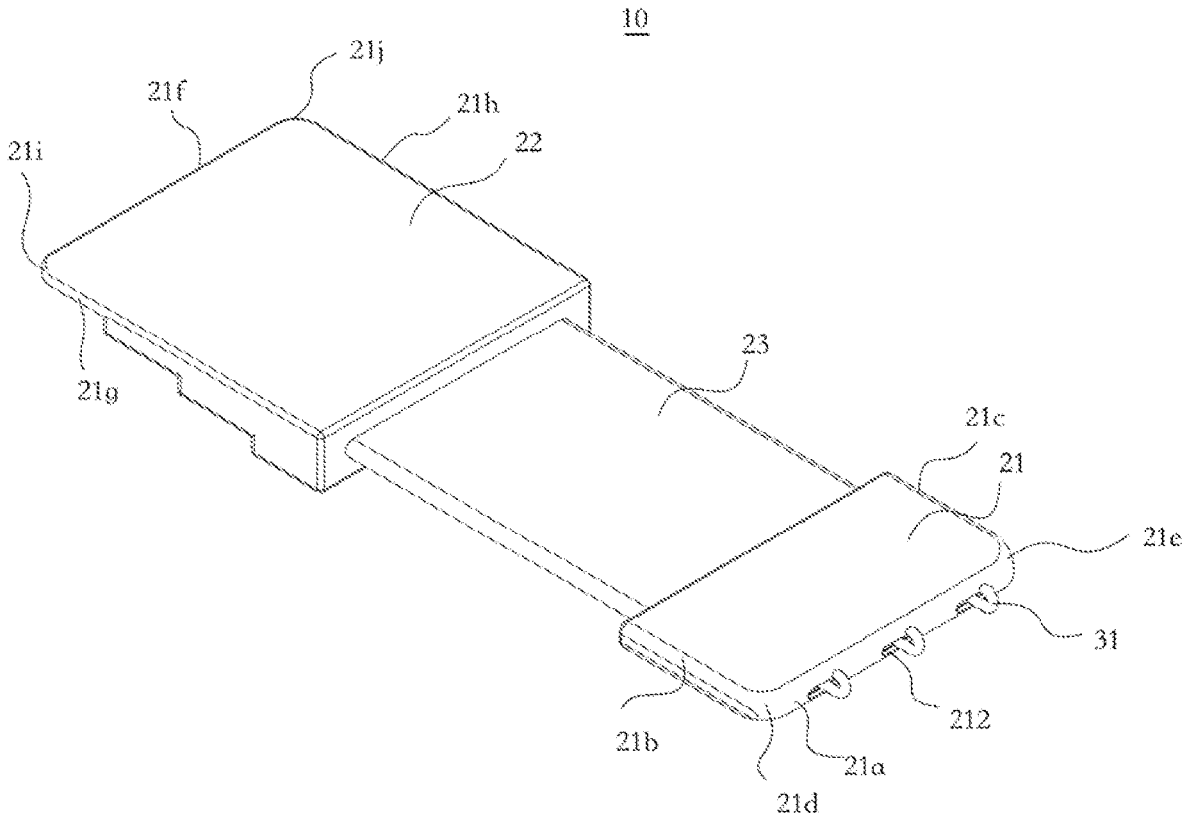
FIG. 2 is a back view of the extension strap of FIG. 1.
Figure 3:
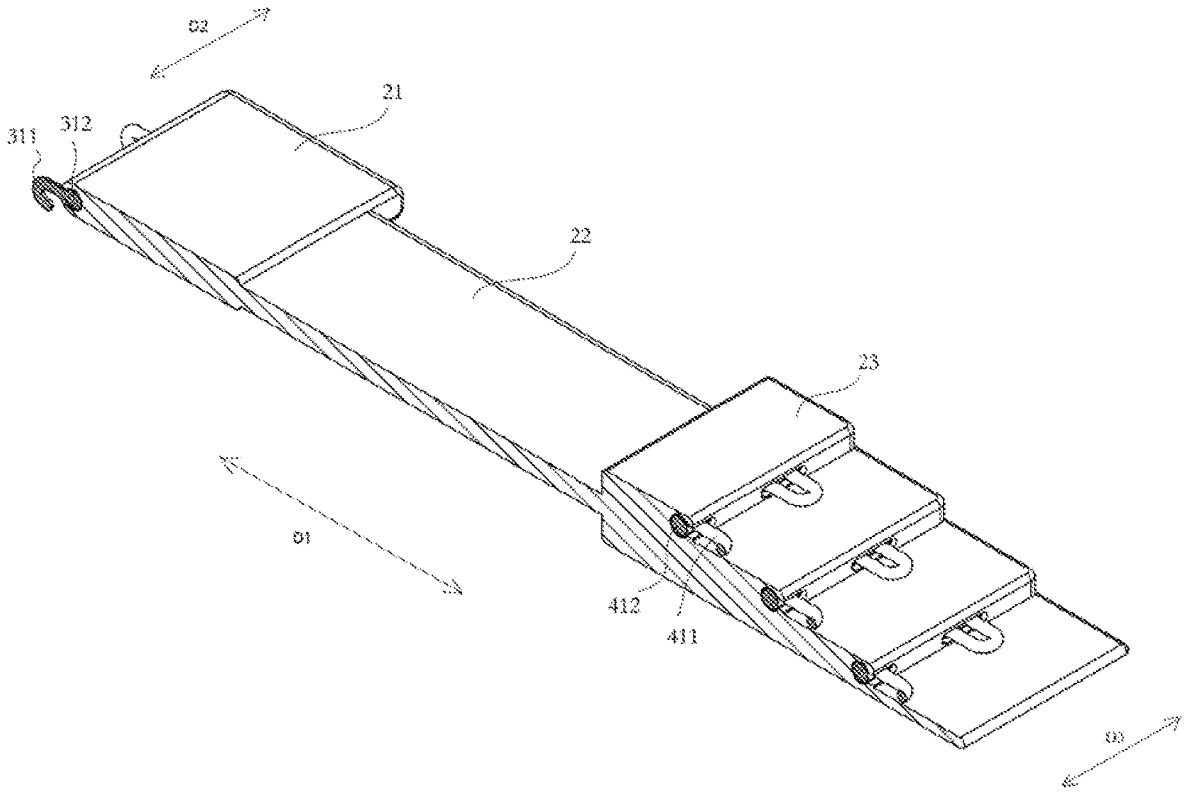
FIG. 3 is a cross-section view of the extension strap of FIG. 1.
Figure 3A:
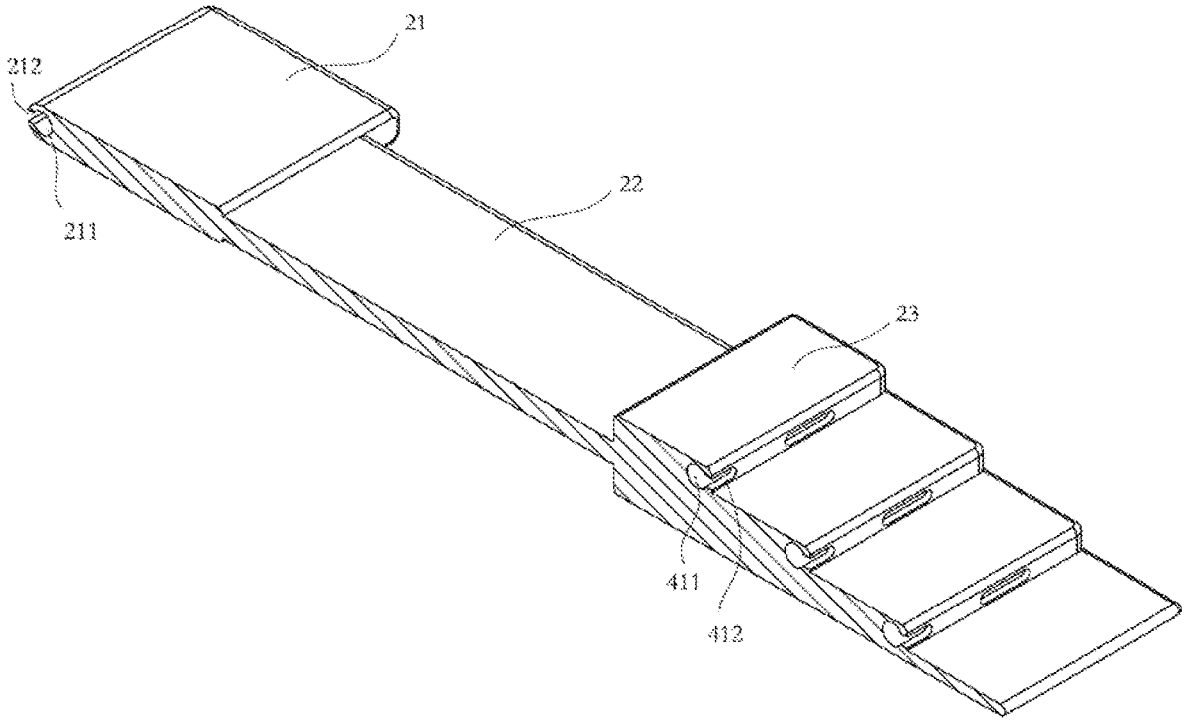
FIG. 3A is the cross-section view of the extension strap of FIG. 1 by concealing the hook elements and the ring elements.
Figure 4:
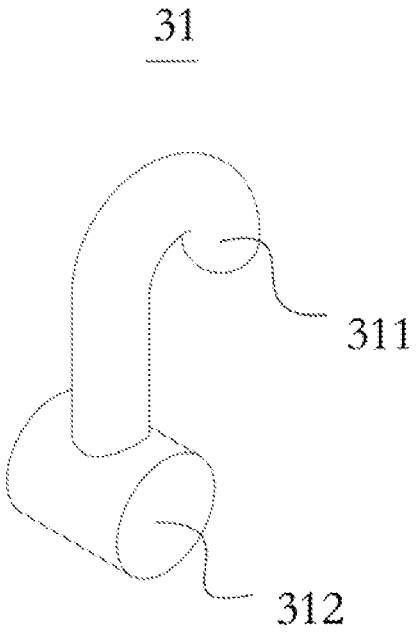
FIG. 4 is a schematic view of a hook element of the extension strap of FIG. 1.
Figure 5:
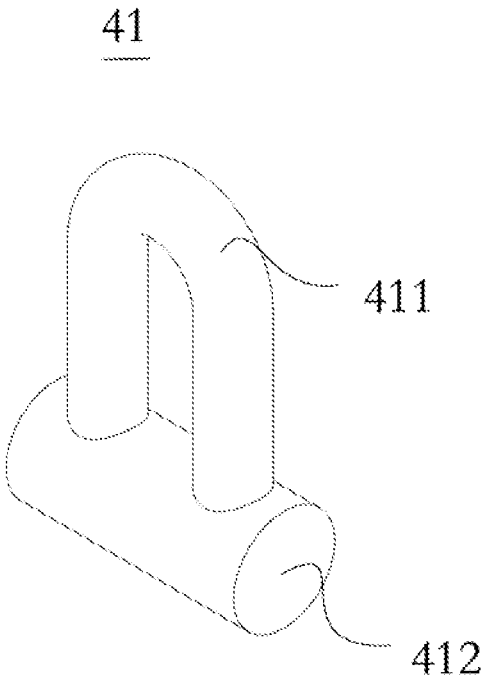
FIG. 5 is a schematic view of a ring element of the extension strap of FIG. 1.

In order to provide a clear understanding of the objects, features, and advantages of the embodiments, the following arc detailed and complete descriptions to the technological solutions adopted in the embodiments. Obviously, the descriptions are part of the whole embodiments. The other embodiments which are not processed creatively by technicians of ordinary skills in the field are under the protection of this disclosure. The same is given with reference to the drawings and specific embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The disclosure, referencing the accompanying drawings, is illustrated by way of examples and not by way of limitation. It should be noted that references to "an" or "one" embodiment in this disclosure are not necessarily to the same embodiment, and such references mean "at least one."

Referring to FIGS. 1-5, an extension strap 10 for a bra according to a first embodiment of the present disclosure includes a base element 20, a hook element group 30 and a plurality of ring element groups 40. The base element 20 includes a first portion 21, a second portion 22 and a third portion 23. The first portion 21, the second portion 22 and the third portion 23 are disposed in a first direction D1, and the third portion 23 is connected between the first portion 21 and the second portion 22. The hook element group 30 is disposed on the first portion 21, and the ring element groups 40 are disposed on the second portion 22.

The first portion 21 includes a plurality of first holding spaces 211 and a plurality of first openings 212 corresponding to the first holding spaces 211 respectively, and each first opening 212 communicates with the corresponding one first holding space 211. The plurality of first holding spaces 211 and the plurality of first openings 212 can be arranged in a second direction D2 perpendicular to the first direction D1.

The second portion 22 includes a plurality of holding units 220 arranged along the first direction D1. Each holding unit 220 includes a plurality of second holding spaces 221 and a plurality of second openings 222 corresponding to the second holding spaces 221 respectively, and each second opening 222 communicates with the corresponding one second holding space 221. In the holding unit 220, both of the plurality of first holding spaces 221 and the plurality of second openings 222 can be arranged in a third direction D3 parallel to the second direction D2.

The hook element group 30 includes a plurality of hook elements 31 configured for connecting with a first back strap of the bra and disposed on an end of the first portion 21 far away from the third portion 23. The plurality of hook elements 31 correspond to the plurality of first holding spaces 211 respectively and are disposed in the second direction D2. Each hook element 31 includes a hook 311 and a connection portion 312 connected with the hook 311. The connection portion 312 is located in a corresponding first holding space 211, and the first hook 311 protruding from a corresponding first opening 212. A width of the first hook 311 along the second direction D2 is less than a width of the corresponding first opening 211. The connection portion 312 is configured to move in the first holding space 211 along the second direction D2 and the first hook 311 is configured to move in the first opening 211 along the second direction D2 so as to change a distance between two hook elements 31. In the first embodiment, the connection portion 312 is a shaft extending along the second direction D2. In another embodiment, the connection portion 312 may be a spherical shape.

The plurality of the ring element groups 40 are disposed along the first direction D1 and corresponds to the plurality of holding units 220 respectively. Each ring element group 40 includes a plurality of ring elements 41 disposed on the second portion 22 along the third direction D3 corresponding to the plurality of second holding spaces 221 respectively. Each ring element 41 includes a ring portion 411 and a base portion 412 connected with the ring portion 411. The base portion 412 is located in a corresponding second holding space 221, and the ring portion 411 protrudes from the second opening 222. A width of the ring portion 411 along the third direction D3 is less than a width of the corresponding second opening 222. The base portion 412 is configured to move in the corresponding second holding space 221 along the third direction D3 and the ring portion 411 is configured to move in the second opening 222 along the third direction D3 so as to change the distance between two ring elements 41.

In the first embodiment, the hook elements 31 are disposed at the end of the first portion 21 far away from the third portion 23 and extend a first side of the base element 20, the ring element group 40 is disposed at a second side opposite to the first side of the base element 20.

The third portion 23 is made of elastic material, a width of the third portion 23 along the second direction D2 is less than a width of the first portion along the second direction D2, the width of the third portion 23 along the second direction D2 is less than a width of the second portion 22 along the second direction D2.

The first portion 21 includes a first edge portion 21*a* far away from the third portion 23, a second edge portion 21*b* connected an end of the first edge portion 21*a* and a third edge portion 21*c* connected the other end of the first edge portion 21*a*, a first chamfer 21*d* is located between the first edge portion 21*a* and the second edge portion 21*b*, a second chamfer 21*e* is located between the first edge portion 21*a* and the third edge portion 21*c*. The second portion 22 includes a fourth edge portion 21*f* far away from the third portion 23, a fifth edge portion 12*g* connected an end of the fourth edge portion 21*f* and a sixth edge portion 21*h* connected the other end of the fourth edge portion 21*f*, a third chamfer 21*i* is located between the fourth edge portion 21*f* and the fifth edge portion 21*g*, a fourth chamfer 21*j* is located between the fourth edge portion 21*f* and the sixth edge portion 21*h*.

Figure 6:
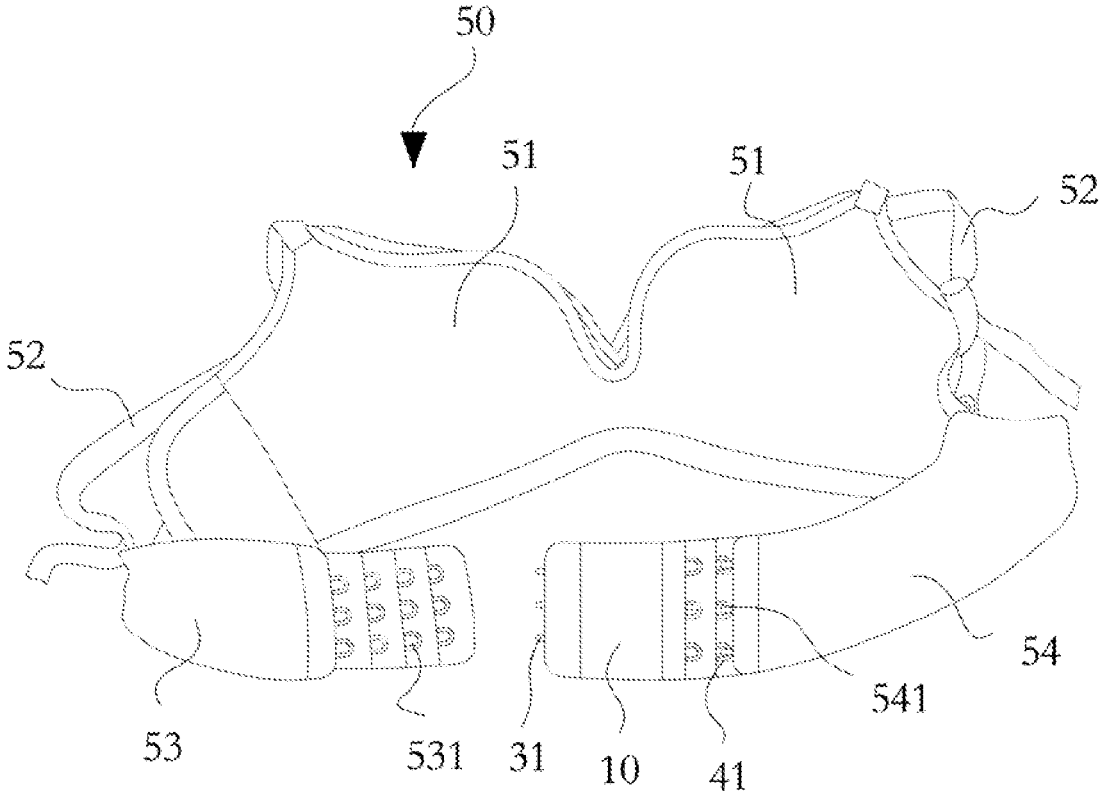
FIG. 6 is a schematic view of the extension strap of FIG. 1 used in the bra.

Referring to FIG. 6, the extension strap 10 can be used in a bra 50. The bra 50 may has two cup portions 51 for cover breasts, two back straps 53 and 54 connected between the two cup portions 51, and two should straps 52 connected between the two cup portions 51 and the two back straps 53 and 54. The first back strap 53 includes a plurality of first connection elements 531 corresponding to the hook elements 31, and the second back strap 54 includes a plurality of second connection elements 531 corresponding to the ring elements 41. The hook elements 31 can be connected to the first connection elements 531, and the ring elements 41 can be connected to the second connection elements 541, such that the extension strap 10 can be detachably connected between the two back straps 53 and 54 so as to extend the length of the bra 50. Then, the users may be easy to put on the bra 50 or feel comfortable when the users wear the bra 50. Further, due to the distance between the two hook elements 31 and the distance between two ring element 41 can be changed, the extension strap 10 can be used in different bras with different hook distances, the user experience of the extension strap 10 can be improved. Furthermore, by the chamfers 21*d*, 21*e*, 21*i* and 21*j*, when the extension strap 10 is used, the user will not feel foreign bodies, the user experience is also improved.

It can be understood, in another embodiment, the number of the hook elements 31, the ring elements 41, the first holding spaces 211, the first openings 212, the second holding spaces 221, the second openings 222 can be reduced or increased according to actual needs, so as to adapt different bras which have back straps 53 and 54 with different widths.

Figure 7:
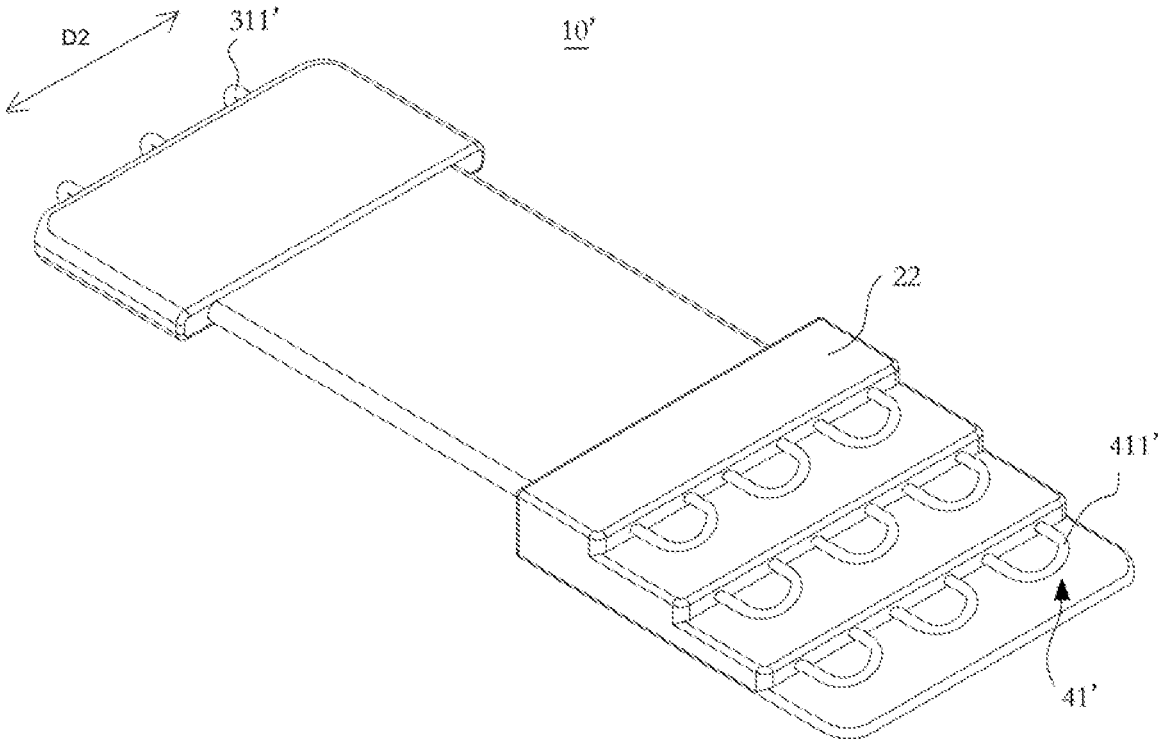
FIG. 7 is a schematic view of an extension strap for a bra according to a second embodiment of the present disclosure.

Referring to FIG. 7, in a second embodiment, second portion 22' may be not have holding units, and ring elements 41' are fixed on the second portion 22', an inner diameter of a ring portion 411' of the second portion 22' along a second direction D2 is greater than a width of a first hook 311' along the second direction D2. In the embodiment, the inner diameter of the ring portion 411' along the second direction D2 is greater than two times of the width of the first hook 311' along the second direction D2.

In the second embodiment, due to the distance between the two hook elements 31' can be changed, and the inner diameter of the ring portion 411' of the second portion 22' along the second direction D2 is greater than the width of the first hook 311' along the second direction D2, the extension strap 10' can be used in different bras with different hook distances, thus the user experience of the extension strap 10' can be improved.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that, modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and, scope of the technical solutions of the respective embodiments of the disclosure.

What is claimed is:

1. An extension strap for a bra, comprising a base element comprising a first portion, a second portion and a third portion, the first portion, the second portion and the third portion disposed in a first direction, the third portion connected between the first portion and the second portion, the first portion comprising at least one first holding space and at least one first opening communicating with the at least one first holding space, the second portion comprising at least one holding unit, each holding unit comprising at least one second holding space and at least one second opening communicating with the at least one second holding space;

a first hook element disposed on the first portion for connecting with a first back strap of the bra, the first hook comprising a first hook and a first connection portion connected with the first hook, the first connection portion located in the first holding space, the first hook protruding from the first opening;

a second hook element disposed on the first portion for connecting with a second back strap of the bra;

at least one ring element group disposed on the second portion, each ring element group comprising a first ring element and a second ring element, both of the first ring element and the second ring element configured for connecting with the second back strap of the bra, the first ring element comprising a first ring portion and a first base portion connected with the first ring portion, the first base portion located in the second holding space, the first ring protruding from the second opening, wherein the first hook is configured to move along the first opening so as to change a distance between the first hook and the second hook, and the first ring portion is configured to move along the second opening so as to change a distance between the first ring portion and the second ring portion.

2. The extension strap according to claim 1, wherein a number of the at least one first holding space is two, a number of the at least one first opening is two, each first opening communicates with a corresponding first holding space, the second hook element comprises a second hook and a second connection portion connected with the second hook, the first connection portion and the second connection portion are located in the first holding spaces respectively, the second hook protrudes from a corresponding first opening, the second hook is configured to move in the corresponding first opening so as to change the distance between the first hook and the second hook along a second direction perpendicular to the first direction.

3. The extension strap according to claim 1, wherein a number of the at least one first holding space is three, a number of the at least one first opening is three, each first opening communicates with a corresponding first holding space, the extension strap further comprises a third hook element disposed on the first portion, the second hook element comprises a second hook and a second connection portion connected with the second hook, the third hook element comprises a third hook and a third connection portion connected with the third hook, the first connection portion, the second connection portion and the third connection portion are located in the three first holding spaces respectively, the second hook protrudes from a corresponding first opening, the second hook is configured to move in the corresponding first opening so as to change the distance between the first hook and the second hook and a distance between the second hook and the third hook, the third hook protrudes from a corresponding first opening, the third hook is configured to move in the corresponding first opening so as to change the distance between the second hook and the third hook along a second direction perpendicular to the first direction, and the first hook element, the second hook element and third hook element are disposed in the second direction.

4. The extension strap according to claim 1, wherein a number of the at least one second holding space is two, a number of the at least one second opening is two, each second opening communicates with a corresponding second holding space, the second ring element comprises a second ring portion and a second base portion connected with the second ring portion, the first base portion and the second base portion are located in the second holding spaces respectively, the second ring portion protrudes from a corresponding second opening, the second ring portion is configured to move along the corresponding second opening so as to change the distance between the first ring element and the second ring element along a second direction perpendicular to the first direction.

5. The extension strap according to claim 1, wherein a number of the at least one second holding space is three, a number of the at least one second opening is three, each second opening communicates with a corresponding second holding space, each ring element group further comprises a third ring element, the second ring element comprises a second ring portion and a second base portion connected with the second ring portion, the third ring element comprises a third ring portion and a third base portion connected with the third ring portion, the first base portion, the second base portion and the third portion are located in the three second holding spaces respectively, the second ring portion protrudes from a corresponding second opening, the second ring portion is configured to move along the corresponding second opening so as to change the distance between the first ring element and the second ring element along a second direction perpendicular to the first direction and a distance between the second ring element and the third ring element along the second direction, the third ring portion protrudes from a corresponding second opening, the third ring portion is configured to move along the corresponding second opening so as to change the distance between the second ring portion and the third ring portion along the second direction.

6. The extension strap according to claim 1, wherein when the first hook moves along the first opening, the first connection portion moves along the first holding space, and when the first ring portion moves along the second opening, the second connection portion moves along the second holding space.

7. The extension strap according to claim 1, wherein the first hook element and the second hook element are disposed in a second direction perpendicular to the first direction; the first ring element and the second ring element are disposed in a third direction parallel to the second direction.

8. The extension strap according to claim 1, wherein the first hook element and the second hook element are disposed at an end of the first portion, both of the first hook and the second hook extend towards a first side of the base element, and the ring element group is disposed at a second side opposite to the first side of the base element.

9. The extension strap according to claim 1, wherein a number of the at least one ring group is three, a number of the at least one holding unit are three, and the three ring groups are disposed in the first direction and correspond to the three holding units respectively.

10. The extension strap according to claim 1, wherein the third portion is made of elastic material, a width of the third portion along a direction perpendicular to the first direction is less than a width of the first portion along the direction perpendicular to the first direction, the width of the third portion along the direction perpendicular to the first direction is less than a width of the second portion along the direction perpendicular to the first direction.

11. The extension strap according to claim 1, wherein the first portion comprises a first edge portion, a second edge portion connected an end of the first edge portion and a third edge portion connected the other end of the first edge portion, a first chamfer is formed between the first edge portion and the second edge portion, a second chamfer is formed between the first edge portion and the third edge portion, the second portion comprises a fourth edge portion, a fifth edge portion connected an end of the fourth edge portion and a sixth edge portion connected the other end of the fourth edge portion, a third chamfer is located between the fourth edge portion and the fifth edge portion, and a fourth chamfer is located between the fourth edge portion and the sixth edge portion.

12. An extension strap for a bra, comprising a base element comprising a first portion, a second portion and a third portion, the first portion, the second portion and the third portion disposed in a first direction, the third portion connected between the first portion and the second portion, the first portion comprising at least one first holding space and at least one first opening communicating with the at least one first holding space;

a first hook element disposed on the first portion for connecting with a first back strap of the bra, the first hook element comprising a first hook and a first connection portion connected with the first hook, the first connection portion located in the first holding space, the first hook protruding from the first opening;

a second hook element disposed on the first portion for connecting with the first back strap of the bra, the first hook element and the second hook element disposed in a second direction perpendicular to the first direction;

at least one ring element group disposed on the second portion for connecting with a second back strap, wherein the first hook is configured to move along the first opening in the second direction so as to change a distance between the first hook element and the second hook element in the second direction.

13. The extension strap according to claim 12, wherein a number of the at least one first holding space is at least two, a number of the at least one first opening is at least two, each first opening communicates with a corresponding first holding space, the second hook element comprises a second hook and a second connection portion connected with the second hook, the first connection portion and the second connection portion are located in the two first holding spaces respectively, the second hook protrudes from a corresponding first opening, the second hook is configured to move along the first opening in the second direction so as to change the distance between the first hook element and the second hook element along the second direction.

14. The extension strap according to claim 12, wherein a number of the at least one first holding space is at least three, a number of the at least one first opening is at least three, each first opening communicates with a corresponding first holding space, the extension strap further comprises a third hook element disposed on the first portion, the second hook element comprises a second hook and a second connection portion connected with the second hook, the third hook element comprises a third hook and a third connection portion connected with the third hook, the first connection portion, the second connection portion and the third connection portion are located in the three first holding spaces respectively, the second hook protrudes from a corresponding first opening, the second hook is configured to move in the corresponding first opening along the second direction so as to change the distance between the first hook element and the second hook element and a distance between the second hook element and the third hook element, the third hook protrudes from a corresponding first opening, the third hook is configured to move in the corresponding first opening along the second direction so as to change the distance between the second hook element and the third hook element, and the first hook element, the second hook element and third hook element are disposed in the second direction.

15. The extension strap according to claim 12, wherein a number of the at least one ring element group is at least two, the at least two ring element groups are arranged in the first direction, the second portion comprises at least two holding units corresponding to the at least two ring element groups, each holding unit comprising at least two second holding space corresponding to the at least two ring elements and at least two second openings communicating with the at least two second holding spaces respectively, each ring element comprises a base portion and a ring portion connected with the base portion, the base portion is located in a corresponding second holding spaces, the ring portion protrudes from the second opening, the ring portion is configured to move in the corresponding second opening along the third direction parallel to the second direction so as to change the distance between two ring elements.

16. The extension strap according to claim 12, wherein the first hook element and the second hook element are disposed at an end of the first portion, both of the first hook and the second hook extend towards a first side of the base element, the ring element group is disposed at a second side opposite to the first side of the base element.

17. The extension strap according to claim 12, wherein the third portion is made of elastic material, a width of the third portion along a direction perpendicular to the first direction is less than a width of the first portion along the direction perpendicular to the first direction, the width of the third portion along the direction perpendicular to the first direction is less than a width of the second portion along the direction perpendicular to the first direction.

18. The extension strap according to claim 12, wherein the first portion comprises a first edge portion, a second edge portion connected an end of the first edge portion and a third edge portion connected the other end of the first edge portion, a first chamfer is located between the first edge portion and the second edge portion, a second chamfer is located between the first edge portion and the third edge portion; the second portion comprises a fourth edge portion [[the fourth edge portion and a sixth edge portion connected the other end of the fourth edge portion, a third chamfer is located between the fourth edge portion and the fifth edge portion, a fourth chamfer is located between the fourth edge portion and the sixth edge portion.

19. The extension strap according to claim 12, wherein the least one ring element group comprises at least two ring elements, each ring element comprises a ring portion and a base portion connected between the ring portion and the second portion, and an inner diameter of the ring portion along the second direction is greater than a width of the first hook along the second direction.

20. The extension strap according to claim 19, wherein the inner diameter of the ring portion along the second direction is greater than two times of the width of the first hook along the second direction.

* * * * *